United States Patent [19]

Kim et al.

[11] 4,088,480

[45] May 9, 1978

[54] PROCESS FOR PREPARING REFRACTORY METAL-SILVER-CADMIUM ALLOYS

[75] Inventors: Han J. Kim, Chelmsford; F. Joseph Reid, Acton; Frederick J. Scimeca, Milford, all of Mass.

[73] Assignee: GTE Laboratories Incorporated, Waltham, Mass.

[21] Appl. No.: 722,856

[22] Filed: Sep. 10, 1976

[51] Int. Cl.[2] ..... B22F 3/26

[52] U.S. Cl. ..... 75/200; 200/264

[58] Field of Search ..... 200/264; 75/200; 29/182.1

[56] References Cited

U.S. PATENT DOCUMENTS

| | | | |
|---|---|---|---|
| 3,125,441 | 3/1964 | Lafferty | 29/182.1 |
| 3,610,859 | 10/1971 | Schreiner et al. | 200/264 |
| 3,686,456 | 8/1972 | Talento | 200/264 |
| 3,852,879 | 12/1974 | Krock et al. | 200/264 |

FOREIGN PATENT DOCUMENTS

| | | | |
|---|---|---|---|
| 2,014,639 | 10/1971 | Germany | 200/264 |

OTHER PUBLICATIONS

Jones, Fundamental Principles of Powder Metallurgy, 1960, pp. 505–507, 770–771.

*Primary Examiner*—Brooks H. Hunt
*Attorney, Agent, or Firm*—David M. Keay

[57] ABSTRACT

This application describes a method of preparing cadmium-containing refractory metal-silver alloys by using a liquid phase sintering technique featuring a cadmium vapor over-pressure. The resultant alloys are useful as electric contacts in high electric current applications.

11 Claims, No Drawings

PROCESS FOR PREPARING REFRACTORY METAL-SILVER-CADMIUM ALLOYS

BACKGROUND OF THE INVENTION

Sintered refractory element-silver contact and silver-cadmium oxide contact members are widely used for high electric current applications due to good erosion resistance and superior arc-interruption characteristics with low temperature rise, respectively. A new contact material combining both the good erosion resistance of refractory element-silver contacts and the good arc-extinguishing characteristics of cadmium oxide in the silver-cadmium oxide contact has been discussed in the industry. One major problem associated with fabricating such a contact is the preservation of cadmium oxide during sintering in a reducing atmosphere required for sintering refractory metal composites. For example, the consolidation of cadmium oxide particles in tungsten-silver composites under cadmiumoverpressure in a closed system is not feasible due to the dissolution of cadmium oxide in the liquid silver and the subsequent oxidation of tungsten to tungstic oxide.

Although improvement in arc-erosion resistance is less dramatic in elemental cadmium-containing contacts than contacts with cadmium oxide, the presence of elemental cadmium is also known to improve the arc-erosion resistance of silver and copper contacts because of the conversion of cadmium into oxide during arcing. The purpose and objects of this invention are related to methods of making elemental cadmium-containing refractory metal-silver contacts by a liquid phase sintering technique.

OBJECTS OF THE INVENTION

The present invention provides a process for preparing refractory metal-silver-cadmium composites which are in turn useful in forming electric contact members.

The present invention further provides novel refractory metal-silver-cadmium contacts, distinquished by their relatively pore-free and tungsten oxide free composite microstructures.

Incorporation of cadmium into this type of contact structure, using the novel process described herein, provides an arc distinquishing capability with consequential increased contact life.

These and further objects, features and advantages of the present invention will be apparent from the following more detailed description.

SUMMARY OF THE INVENTION

The present invention is achieved, in accordance herewith, by alloying the arc-extinquishing component, cadmium, with silver-refractory metal composites by use of a liquid phase sintering technique featuring a cadmium over-pressure.

During the sintering process, the use of the cadmium over-pressure permits the infiltration of cadmium from a silver-cadmium mixture into a refractory metal-silver skeleton, prevents the oxidation of cadmium in the mixture and effectively suppresses its vaporization. In addition, the cadmium reservoir establishing the over-pressure contributes to further lowering of the system oxygen pressure toward the equilibrium pressure for the formation of cadmium oxide. Since the equilibrium oxygen pressure required for the formation of tungsten oxide at this pressure is greater, if tungsten is present as a component, it is not oxidized, which is important to ensure successful infiltration by the molten silver-cadmium alloy.

The process of the present invention involves the preparation of refractory metal-silver-cadmium alloys, by infiltration of cadmium metal into the refractory metal-silver compact using an over-pressure of cadmium.

The base compact, or skeleton, containing a refractory metal and silver, is prepared using the usual liquid phase sintering methods. For example, a powder containing silver and other refractory metal(s), such as tungsten, tungsten carbide, molybdenum, etc. or mixtures thereof is pressed into a compact and sintered at usual sintering temperatures, etc. about 1200° C, for a sufficient period of time(e.g. 30 min to/hr) and under suitable conditions, e.g. a reducing atmosphere where tungsten is present, to prepare a rigid base compact or skeleton.

A slug containing cadmium and silver, is placed on a surface of the base compact. The resultant assembly is then sintered at an elevated temperature under a cadmium over-pressure for a period of time sufficient to complete the infiltration of cadmium from the cadmium-silver slug into the base compact. The slug may also contain (relatively small) amounts of a third metal such as nickel.

The elevated temperature corresponds to those temperatures commonly employed for sintering, i.e. from about 1000° C to about 1300° C. The cadmium over-pressure is provided by vaporizing a separate cadmium source or reservoir at a temperature of from about 500 to about 800° C. A closed system is employed.

The sintering time with cadmium over-pressure ranges from about 1 to about 15 minutes, sufficient to substantially complete alloy infiltration. Longer infiltration times, up to, for example, 30 minutes may be used if desired.

A suitable cadmium over-pressure of approximately from 0.1 to 1 atmosphere can be generated in a system by maintaining the cadmium source or reservoir at from about 500 to 800° C. A temperature of about 700° C corresponds to an oxygen pressure of about $2.5 \times 10^{-4}$ atmosphere for the formation of cadmium oxide at 1200° C, which is much higher than the oxygen pressure prevailing in the system. Therefore, the presence of the cadmium overpressure not only prevents the oxidation of cadmium in the alloy, but also effectively suppresses its vaporization and thus permits infiltration thereof into the base compact or skeleton. In addition, the cadmium reservoir contributes to further lowering of the system oxygen pressure toward the equilibrium pressure for the formation of cadmium oxide at the reservoir temperature. Also, tungsten, if present, is not oxidized as the equilibrium oxygen pressure for its oxidation is higher than the lowered system pressure of oxygen.

The contacts of the present invention are prepared by infiltrating cadmium metal into a refractory metal alloy containing silver metal. Other metals which can be employed in this alloy include tungsten carbide, molybdenum and so forth: tungsten is presently preferred.

The compositions of the contacts may vary within relatively wide limits. In general, the cadmium component is present in the final contact or alloy within a range of from about 1 to about 5%, the silver component from about 5 to about 95%, and the other combined metals from about 5 to about 95%. Best results are achieved when preparing final contacts containing from about 4 to 5% cadmium, about 40 to about 50%, silver, and about 45 to about 56% other, combined refractory metal(s).

The base compact or skeleton generally contains from about 5 to about 95% refractory metal and from about 5 to about 95%, respectively, silver. The slug generally contains from about 77 to about 95% silver and from about 5 to about 23%, respectively, cadmium.

The novel product prepared by the novel process hereof exhibits the microstructure of an interconnected refractory metal skeleton filled with a single phase silver-cadmium alloy and is substantially pore-free and tungsten oxide-free.

DESCRIPTION OF SPECIFIC EMBODIMENTS

The following examples serve to further illustrate the present invention and set forth the preferred embodiments for the practice hereof. As such, however, they are not to be considered as limitations upon the overall scope hereof.

EXAMPLE I

A powder compact consisting of 36 weight % silver, 48 weight % tungsten and 16 weight % tungsten carbide was sintered in a reducing (hydrogen) atmosphere at 1200° C to provide a 75% dense skeleton structure. (25% pores)

A slug containing 77 weight % silver, 22.6 weight % cadmium, and 0.4 weight % nickel was placed on the skeleton surface and the entire assembly was placed on a graphite support plate. The weight of the slug was approximately one-third of the skeleton weight. The bottom side of the skeleton was coated with graphite powder to prevent flow-through of the molten slug.

The whole assembly was inserted into one end of a quartz tube and cadmium metal was positioned in the other end of the tube, and the system was evacuated to about $10^{-5}$ torr vacuum prior to sealing. The ampule (tube) was placed in a furnace having a temperature gradient such that the alloy-skeleton assembly was at 1200° C and the cadmium metal at 700° C. A total of 2 minutes of sintering time was sufficient to complete the slug infiltration into the skeleton.

The cadmium over-pressure of approximately 0.5 atmosphere generated in the system by maintaining the cadmium source at 700° C corresponds to an oxygen pressure of $2.5 \times 10^{-4}$ atmosphere for the formation of cadmium oxide at 1200° C, which is much higher than the oxygen pressure prevailing in the system. The presence of the cadmium over-pressure thus not only prevented the oxidation of cadmium in the slug, but also effectively suppressed its vaporization so as to allow infiltration into the skeleton structure. In addition, the cadmium reservior contributed to further lowering of the system oxygen pressure toward the equilibrium pressure for the formation of cadmium oxide, i.e. $5.8 \times 10^{-18}$ atmosphere. Since the equilibrium pressure for the formation of tungsten oxide at 1200° C is $6.3 \times 10^{-12}$ atmosphere, the tungsten component in the skeleton is not oxidized.

The amount of cadmium incorporated was approximately 5 weight % of the final contact, which corresponds to approximately 70% of the total cadmium contained in the slug. A substantially pore-free structure having a hardness value of over 200 kg./mm$^2$ (Knoop scale, 50g load) was obtained. The composition of the finished contact was as follows:

| | |
|---|---|
| silver | 54 weight % |
| Cadmium | 5 weight % |
| nickel | 0.1 weight % |
| tungsten | 30.7 weight % |
| tungsten carbide | 10.2 weight % |

EXAMPLE II–III

Contacts are prepared according to the procedures of Example I, as modified according to the conditions as set forth below in Table I, and with the results as set forth below in Table II:

TABLE I

| Ex. | Skeleton Blend, wt.% | Alloy Blend, wt.% | Sintering Temp. of Skeleton-Blend assembly, ° C | Temp. of Cadmium Source | Sintering time min. |
|---|---|---|---|---|---|
| II | silver, 36 Tungsten, 48 Tungsten Carbide, 16 | Silver, 77 Cadmium, 22.6 nickel, 0.4 | 1230 | 506 | 5 |
| III | " | " | 1250 | 700 | 2 |

TABLE II

| Example | Composition, weight % | Hardness, Knoop scale | Density, 8/cc |
|---|---|---|---|
| II | silver, 52 Tungsten, 35 Cadmium, 1.2 Tungsten Carbide, 11.7 Nickel 0.1 | (50g load), Kg.mm$^2$ 200 | 12.8 |
| III | silver 54.1 Tungsten 30.8 Cadmium 4.7 Tungsten Carbide 10.3 Nickel 0.1 | 210 | 13.0 |

We claim:

1. A process for preparing a composite of a refractory material, silver, and cadmium which comprises infiltrating cadmium metal into a compact of a refractory material and silver wherein the refractory material is selected from the group consisting of tungsten, tungsten carbide, molybdenum, and mixtures thereof using an over-pressure of cadmium at an elevated temperature.

2. The process of claim 1 wherein said cadmium metal is in the form of a silver-cadmium mixture.

3. The process of claim 2 wherein said silver-cadmium mixture contains from about 77 to about 95% silver and from about 5 to about 23% cadmium.

4. The process of claim 1 wherein the cadmium over-pressure is about 0.5 atmosphere.

5. The process of claim 1 conducted at a sintering temperature of from about 1000° to about 1300° C.

6. The process of claim 1 wherein the cadmium over-pressure is generated in a closed system by heating cadmium metal at from about 500° to about 800° C.

7. The process of claim 1 wherein said compact contains from about 5% to about 95% silver particles.

8. The process of claim 1 wherein said composite contains about 5% to about 95% silver and from about 1% to about 5% cadmium particles.

9. A process for preparing a composite of a refractory material, silver, and cadmium which comprises providing a compact of a refractory material and silver wherein the refractory material is selected from the group consisting of tungsten, tungsten carbide, molybdenum, and mixtures thereof, contacting said compact with cadmium metal, and heating the assembly using an over-pressure of cadmium.

10. The process of claim 9 wherein the cadmium metal is in the form of a silver-cadmium mixture.

11. The process of claim 9 wherein the cadmium over pressure is generated in a closed system by vaporizing a separate cadmium source at a temperature from about 500° to about 800° C.

* * * * *